United States Patent [19]

Hambleton et al.

[11] Patent Number: 4,732,275

[45] Date of Patent: Mar. 22, 1988

[54] OPENABLE AND RECLOSABLE CARTON

[75] Inventors: Thomas P. Hambleton, Thompson Ridge, N.Y.; Benjamin J. Cassidy, Waldwick, N.J.; James L. Sosler, Florida, N.Y.

[73] Assignee: International Paper Company, Purchase, N.Y.

[21] Appl. No.: 66,585

[22] Filed: Jun. 26, 1987

[51] Int. Cl.[4] ..... B65D 5/74

[52] U.S. Cl. ..... 206/611; 206/621.3; 206/626; 206/631.2

[58] Field of Search ..... 206/608, 611, 621, 626, 206/621.3, 631.2

[56] References Cited

U.S. PATENT DOCUMENTS

| | | | |
|---|---|---|---|
| 2,132,925 | 10/1938 | Bensel | 206/621.3 |
| 3,003,673 | 10/1961 | Clark | 206/621.3 |
| 3,059,826 | 10/1962 | Harms | 206/621.3 |
| 3,095,135 | 6/1963 | Hennessey | 229/125.42 |
| 3,136,471 | 6/1964 | Brastad | 220/417 |
| 3,263,899 | 8/1966 | Collura | 206/611 |
| 3,361,327 | 1/1968 | Waldrop | 206/626 |
| 3,426,955 | 2/1969 | Olson | 206/622 |
| 3,477,632 | 11/1969 | Donahue | 206/621.5 |
| 3,498,522 | 3/1970 | Peet | 206/626 |
| 3,869,078 | 3/1975 | Braun | 229/17 R |
| 3,892,347 | 7/1975 | Egleston | 229/17 R |
| 4,520,929 | 6/1985 | Lisiecki | 206/610 |
| 4,657,143 | 4/1987 | Forbes, Jr. | 206/621.3 |

FOREIGN PATENT DOCUMENTS

| | | | |
|---|---|---|---|
| 1419392 | 10/1965 | France | 206/626 |

*Primary Examiner*—Stephen Marcus
*Assistant Examiner*—Gary E. Elkins
*Attorney, Agent, or Firm*—Walt Thomas Zielinski

[57] ABSTRACT

An openable and reclosable pour spout forming carton formed from a one-piece blank of paperboard. The carton is generally brick shaped and has a sealing fin on its upper surface, the fin defined by two panels sealingly adhered together. This double thickness fin is adhered to the top of the carton by first folding it and then glueing so as to lie flat. One fin forming flap is provided with a tear strip which, after tearing, defines a tuck tab on the flap. The tuck tab, after partial carton dispensing through the pour spout, is placed beneath a tuck edge portion of the other fin forming panel. By this arrangement, the pour spout can be more fully reclosed and thus will inhibit contamination of the carton contents after the initial carton opening, partial contents dispensing, and pour spout reclosing.

2 Claims, 7 Drawing Figures

OPENABLE AND RECLOSABLE CARTON

BACKGROUND OF THE INVENTION

This invention relates to a paperboard carton which is openable and reclosable to thereby provide for sequential partial dispensing of the carton contents. The invention displays particular utility in the packaging of foodstuffs.

The prior art is aware of a variety of cartons in the general shape of a rectangular parallelepiped and fashioned from paperboard or other stiff, resilient and bendable sheet material which may be readily erected or set-up by means of automatic machinery to thereby facilitate mass production. In certain types of these rectangular parallelepiped cartons, it is desirable to provide a seal at the base of a double paneled fin at the top of the carton, and to bend and hold the fin down by means of an adhesive. The seal at the base of the fin is often required to insure freshness of the product in the carton or container. One example of such a construction is afforded by U.S. Pat. No. 3,869,078, issued to Braun. This type of container exhibits both a seal at the base of a fin running along the top of the container, and is also provided with a tear strip to enable access to a pouring spout within the carton. In use, one rips the tear strip and then forms a pour spout. After a partial dispensing of the contents, the pour spout is refolded and tucked back. However, due to the resiliency of the paperboard, the pour spout often does not assume its original, completely tucked-in configuration.

SUMMARY OF THE INVENTION

According to the practice of this invention, an openable paperboard carton is provided with a tear strip to facilitate opening of the carton and permits subsequent formation of a pouring spout, together with an arrangement for reclosing the top of the carton and thereby assist in maintaining the reclosed pour spout in its original, closed configuration. By insuring that the pour spout is in its original configuration after a partial dispensing of the carton contents, greater freshness and protection from atmospheric contaminants is realized.

The carton of this invention is formed from a one-piece blank of paperboard which is suitably cut and scored to define fold lines and exhibits ready capability of manufacture by automatic machinery.

DETAILED DESCRIPTION OF THE INVENTION

Figure 1:
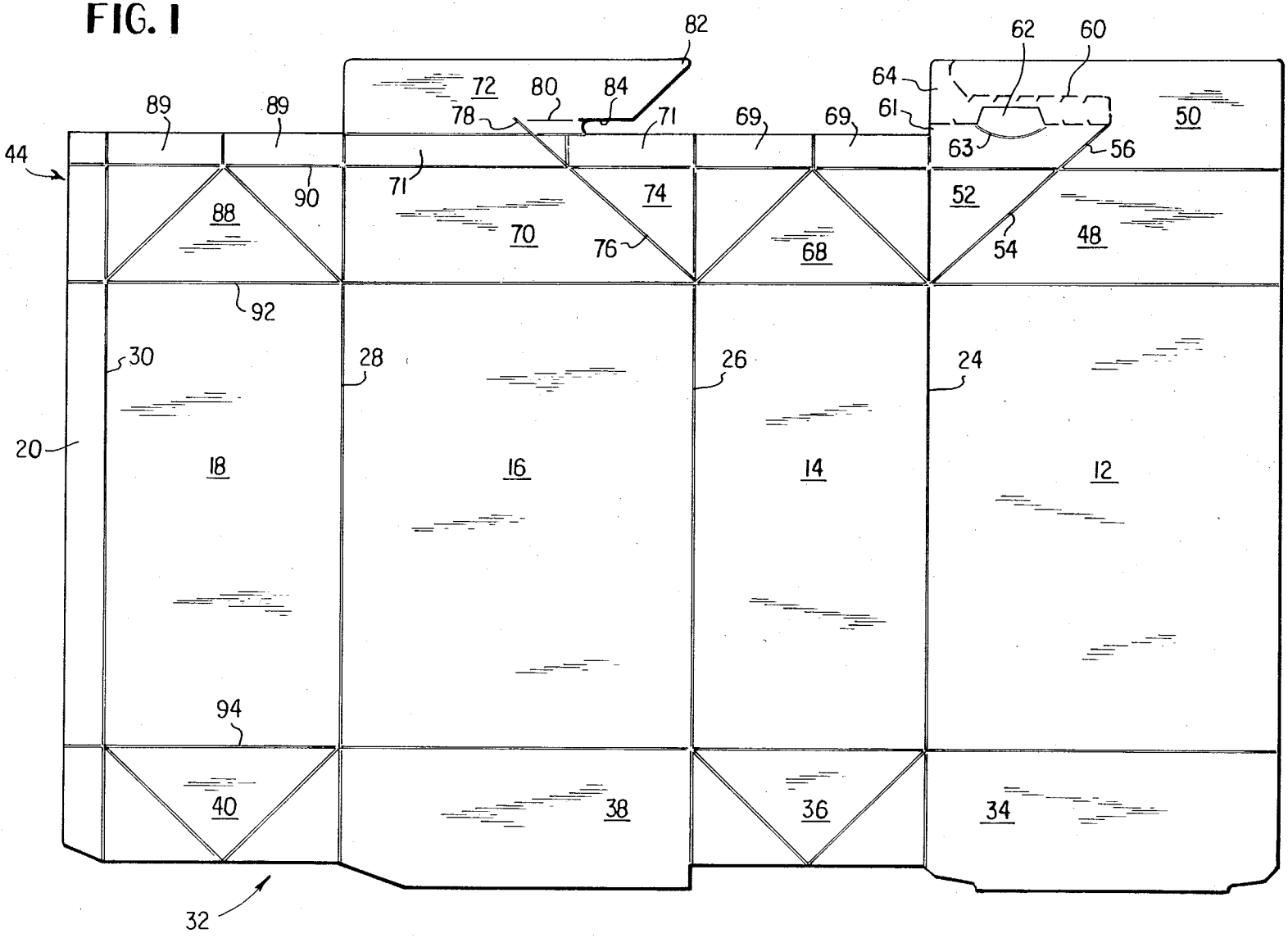
FIG. 1 is a plan view of the one-piece paperboard blank from which the carton of this invention may be formed.

Referring now to FIG. 1 of the drawings, the numeral 10 denotes generally the one-piece blank from which the carton of this invention is formed, the blank fashioned from paperboard or other resilient, stiff and bendable sheet material. FIG. 1 shows that surface of the blank which will be the interior surface of the carton, the interior surface, as well as the exterior surface, usually being coated with one or more layers of a plastic material, such as extruded polyethylene. The coating may include one or more thin metal layers, such as layers of aluminum. The precise coatings and their manner of formation on the blank form no part of this invention.

The numerals 12, 14, 16, and 18 denote serially connected main panels defined by horizontally and vertically extending score lines, these lines becoming fold lines during assembly. The numeral 20 denotes the usual manufacturer's flap to which an adhesive is applied for engagement with a corresponding right-hand edge of panel 12. Panels 12 and 16 are termed side panels while panels 14 and 18 are termed end panels.

The numerals 24, 26, 28 and 30 denote several of the previously mentioned vertically extending score lines.

The numeral 32 denotes generally a series of bottom closure forming panels integrally secured to their corresponding side and end main panels and are denoted by the numerals 34, 36, 38 and 40. In general, the bottom end forming structure is already known, as may be seen by reference to FIG. 1 of the noted Braun patent.

The numeral 44 denotes a series of top closure forming panels which are attached to their corresponding side and end main panels. The top forming panels are denoted by the numerals 48, 68, 70, and 88. Top panel 48 has a triangular portion 52 defined by score line 54, and is integrally secured to one fin forming panel 50. In turn, panel 50 is provided with a score line 56 which is colinear with score line 54, tear or rip forming scores 60, which are interrupted and which extend completely through the thickness of the paperboard. Similarly, tuck tab 62 is formed by the illustrated cuts extending completely through the paperboard and is hinged to panel 50 by means of curved score line 63. Each of the three sides of tuck tab 62 is integrally secured to a portion of tear strip 64 by small, rupturable lands, not illustrated. The numeral 64 denotes a tear strip which is adapted to be manually grasped between the thumb and the index finger of the user for ripping out, as will later be explained.

The numeral 72 denotes a second fin forming panel and is provided with a score line 78 colinear with score line 76 of panel 70. Cut line 80 extends generally horizontally, while numeral 82 denotes a projection having one side at an angle of about 45 degrees with respect to the horizontal. The numeral 84 denotes one edge of the projecting portion 82, edge 84 extending generally horizontally and termed a tuck edge. The left end of edge 84 is provided with a colinear cut which extends leftward, short of the right end of cut 84, by a small amount, typically 1/16th of an inch. During initial opening, this short land area becomes ripped.

The numerals 69, 71, and 89 denote panels defined by the indicated score lines, one of which is horizontally extending score line 90. Score line 90 also divides panels 48 and 50. Except for panels 50 and 72, the top closure forming panels 44 are generally known in the art, as may be seen by reference to FIG. 1 of the noted Braun patent.

Figure 2:
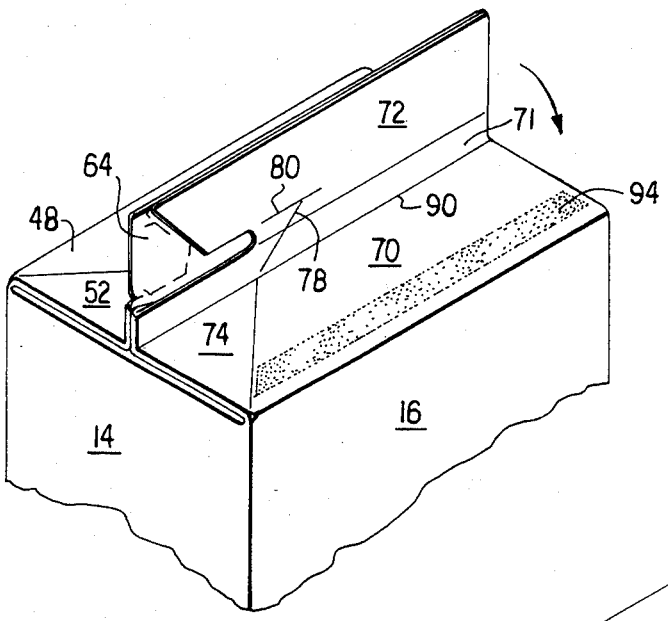
FIG. 2 is a view illustrating the carton after it has been erected and filled and partially sealed.
Figure 3:
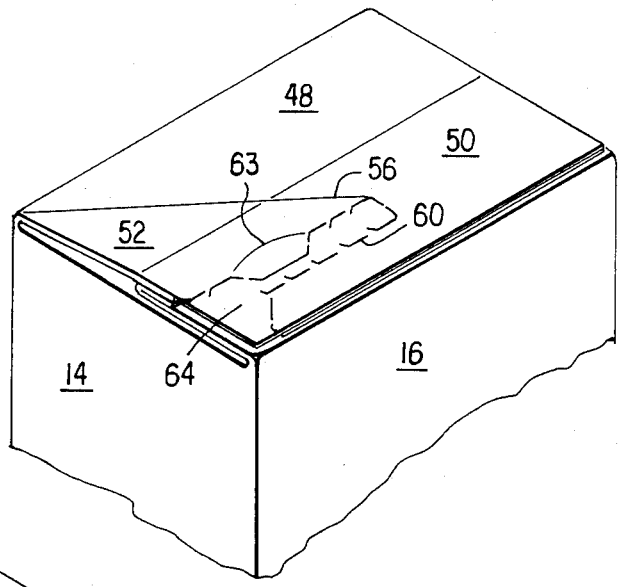
FIG. 3 is a view similar to FIG. 2 and shows the carton in its fully sealed configuration.

Referring now to FIG. 2 of the drawings, the carton has been erected, with the bottom panels 32 having been folded and secured together in a conventional manner to form a bottom. Similarly, the top panels 44 have been folded together to form a substantially flat carton, while fin forming panels 50 and 72 are in their upright position, as indicated at FIG. 2. In FIG. 2, a first seal has been formed by securing together panel portion 71 of panel 70 to the opposite and corresponding zone or area of panel 50. In practice, the entire oppositely facing surfaces of the fin panels are adhered together. This sealing may be effected in any number of known ways, such as by applying heat and pressure, to partially melt and thereby fuse polyethylene coatings on the paperboard. The numeral 94 denotes an area or a zone of an adhesive which is adapted to contact the top edge of panel 72. As shown at FIG. 3, the fin forming panels 50 and 72 have been folded down, about score line 90 as an axis, with the fin being held in the position shown at FIG. 3 by means of the adhesive 94 on panel 70. FIG. 3 thus illustrates the carton in its fully closed position, and is ready for storage, shipment or the like.

Figure 4:
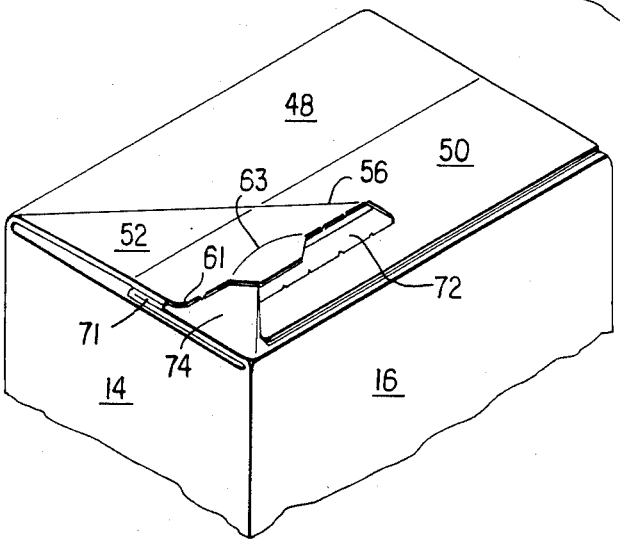
FIG. 4 is a view similar to FIG. 3 and shows the carton after a tear strip has been removed, prior to the initial opening of the carton.
Figure 5:
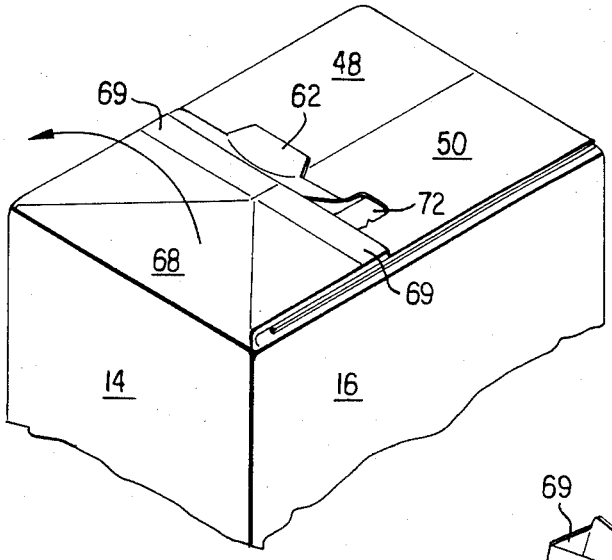
FIG. 5 is a view similar to FIG. 4, and illustrates the carton after a portion of it shown at FIG. 4 has been folded down.
Figure 6:
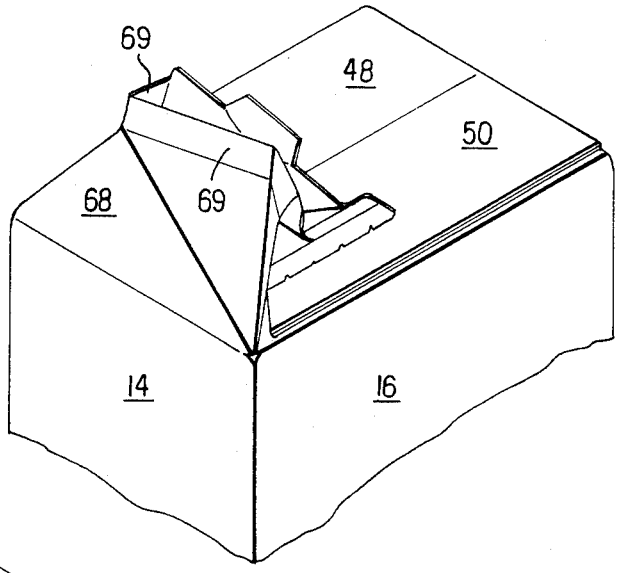
FIG. 6 is a view similar to FIG. 5, and shows a pour spout having been formed from the carton for dispensing a portion of its contents.

FIG. 4 illustrates the first step in opening the carton. The end of tear strip 64 is grasped and ripped away. This exposes portion 74 of panel 70. Next, the user grasps edge 61 of panel 50, this edge having been defined by the ripping off of tear strip 64. Edge 61 is now pulled upwardly and is folded to the left, so that the carton now defines the configuration shown at Figure 5. Next, the mid-portion of panels 69 is pulled upwardly, as indicated by the curved arrow at FIG. 5, to thereby define a pour spout, as illustrated at FIG. 6. The formation of the pour spout is similar to that illustrated at FIG. 9 of the noted patent to Braun.

Figure 7:
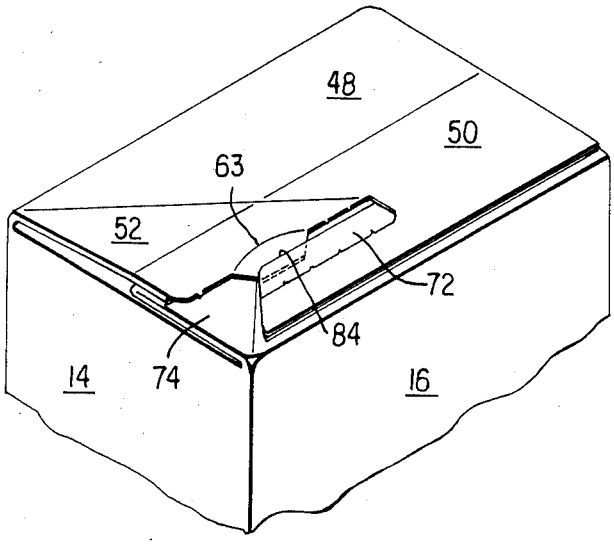
FIG. 7 is a view similar to FIG. 6, showing the pour spout having been refolded and held in its refolded position by means of the tab lock construction of this invention.

The contents of the container can now be partially dispensed. After such dispensing, the pour spout is reclosed by refolding and tuck tab 62 is placed beneath tuck edge 84 of fin forming panel 72. Tab 62 is shown in dashed lines at FIG. 7. It will be noted that fin forming panel 50 remains flat during the spout forming opening and reclosing steps, no force tending to delaminate the top of the dual panel fin structure during pour spout formation, by virtue of the cut on panel 72 which defines projection 82. Thus, as shown at FIG. 7, the carton in its refolded position is essentially flat, as it was prior to opening, as shown at FIG. 3.

The terms "vertical", "horizontal", "upper" and "lower" have been employed as terms of reference to facilitate the description and are not to be intended as terms of limitation.

We claim:

1. A one piece blank of stiff, foldable and resilient sheet material, said blank being cut and scored and adapted to be folded to define an openable and reclosable carton of rectangular parallelepiped shape, the blank including serially arranged main panels defined by score lines, said main panels being generally rectangular and each having a top forming and a bottom forming closure panel integrally carried thereby to define a plurality of bottom closure panels and a plurality of top closure panels, two of said main panels being sidewall forming and the remaining two main panels being endwall forming, at least one of the top closure forming panels carried by a respective endwall forming panel scored to define a reclosable pour spout, the top closure forming panel carried by each sidewall forming panel foldably carrying a fin panel, one fin panel being recessed at one end thereof to form a tuck edge spaced from an outer edge of said top closure forming panel associated therewith, the other said fin panel being partially cut to define a tear strip and tuck tab, whereby tearing the tear strip away exposes and defines the tuck tab.

2. An openable and reclosable carton formed from a unitary blank of stiff, resilient and bendable sheet material, the carton being in the shape of a rectangular parallelepiped having side, end, top and bottom walls, the top wall having, adjacent one end thereof, an openable and reclosable pour spout, the top wall including a fin defined by two fin panels sealingly adhered together along base portions in facing, abutting relation, said fin folded and glued so as to lie flat on said top wall and become a part of said top wall, one of said fin panels being cut away at one end thereof to define a recess, one portion of said recess defining a tuck edge, the other of said fin panels having a tear strip at one end thereof, said tear strip exposing and defining a tuck tab integral with said other fin panel, whereby when said tear strip is torn away the pour spout can be opened for dispensing and can be reclosed and maintained in a reclosed position by tucking said tuck tab beneath said tuck edge.

* * * * *